United States Patent [19]

Kennedy et al.

[11] Patent Number: 4,586,762

[45] Date of Patent: May 6, 1986

[54] DOOR AND DRAWER FRONT HAVING A RECESSED GRASPING SURFACE

[75] Inventors: Joe H. Kennedy, Bay Minette, Ala.; A. Ronald Holland, Center Point, Pa.; Thomas Richey, Bay Minette, Ala.; James D. Alsup, Jr., Conyers, Ga.

[73] Assignee: Syntex (U.S.A.) Inc., Palo Alto, Calif.

[21] Appl. No.: 514,917

[22] Filed: Jul. 18, 1983

[51] Int. Cl.[4] ..... A47B 95/02

[52] U.S. Cl. ..... 312/330 R; D6/494; D6/446; 16/110 R; 16/DIG. 12; 16/DIG. 18; 49/460; 220/94 A; 312/138 R; 312/204; 312/320

[58] Field of Search ..... 312/138 R, 204, 209, 312/320, 244, 330 R, 330 SM, 126; 16/111 R, 110 R, DIG. 12, DIG. 18, 124; D6/191, 494; 220/94 A; 40/325; 49/460

[56] References Cited

U.S. PATENT DOCUMENTS

| | | | |
|---|---|---|---|
| D. 195,470 | 6/1963 | Knoll | D6/494 |
| 731,330 | 6/1903 | Woodruff | 312/320 X |
| 1,304,700 | 5/1919 | Otte | 312/320 |
| 2,653,851 | 9/1953 | Davidson | 312/320 |
| 2,842,420 | 7/1958 | Hansen et al. | 312/204 X |
| 3,117,339 | 1/1964 | Vigna | 312/320 X |
| 3,775,808 | 12/1973 | Little | 312/330 R X |
| 3,797,731 | 3/1974 | Weldon | 220/94 A X |
| 3,797,904 | 3/1974 | Krauth | 312/204 X |
| 3,846,003 | 11/1974 | Rockwell | 312/204 |
| 3,932,010 | 1/1976 | Kenworthy | 312/320 |
| 4,090,757 | 5/1978 | Frey et al. | 312/320 |

FOREIGN PATENT DOCUMENTS

| | | | |
|---|---|---|---|
| 2218738 | 11/1973 | Fed. Rep. of Germany | 312/320 |
| 1420851 | 1/1965 | France | 312/320 |
| 1487423 | 7/1967 | France | 312/204 |
| 2519242 | 7/1983 | France | 312/209 |
| 654336 | 6/1951 | United Kingdom | 312/320 |
| 1289308 | 9/1972 | United Kingdom | 312/330 R |

*Primary Examiner*—William E. Lyddane
*Assistant Examiner*—Thomas A. Rendos
*Attorney, Agent, or Firm*—Derek P. Freyberg; David A. Lowin

[57] ABSTRACT

A door and drawer front particularly for use in clean-rooms has an outer member and a recessed area having a top grasping surface and a bottom grasping surface extending back into the outer member. A cleaning access area is also provided. The intersections and corners of the member, the recess and the grasping surfaces forming rounded junctions to facilitate easy cleaning and disinfecting of the door and drawer front.

13 Claims, 8 Drawing Figures

DOOR AND DRAWER FRONT HAVING A RECESSED GRASPING SURFACE

CROSS-REFERENCE TO RELATED APPLICATION

This application is related to the subject matter of copending and commonly assigned U.S. patent application Ser. No. 06/514,908, filed July 18, 1983, for Drawer and Door Front Design.

BACKGROUND OF THE DISCLOSURE

The present invention relates to door and drawer pulls, particularly to a recessed grasping surface for use in dental operatories and other sterile or "clean room" environments.

In the sterile environment of a dental operatory, an operating theater, a research facility, a manufacturing or packaging facility subject to FDA regulations, or even a kitchen, it is important to be able to clean all exposed surfaces thoroughly to prevent the growth and spread of bacteria, mold, etc. Furthermore, as a safety feature, it is desireable to have a door or drawer-opening grasping surface that is recessed into the door or drawer front, in order to protect against catching the clothing of persons working in the area. The elimination of unreachable corners and abutting edges between drawer fronts and attached pulling devices (such areas being very difficult to clean and, therefore, prime sites for bacterial growth) is also desired. Aesthetically, a clean line for the cabinet in which the door or drawer is mounted is an important feature.

Another feature that is desired in a pulling surface for laboratories, and especially for dental operatories, is that it be easy to grasp whether the user is standing, and therefore usually reaching down from above the grasping surface, or sitting and reaching from under the grasping surface.

The variety of door and drawer pulls that have existed in the prior art is far too great to be described in detail herein. In one example, drawer fronts have employed sloped top and bottom edges, leaving space between adjacent drawers to facilitate pulling against the sloped surface. This, however, creates a risk for the spread of bacteria from the hands of a user into the storage area of the drawer.

It is an object of the present invention to provide a recessed pulling surface for doors and drawers to be used in "clean room" situations.

Another object of the present invention is to provide a recessed pulling surface that can be easily grasped from above or below.

Still another object of the present invention is to provide a grasping surface that satisfies the foregoing objects and remains easy to clean thoroughly, having no unreachable, sharply angled edges where bacteria could grow.

A further object of the invention is to provide a grasping surface that satisfies all of the foregoing objects and can be made from a single piece of vacuum-formed plastic.

A still further object of the invention is to provide a drawer for use in "clean room" situations that is itself readily cleanable and employes a grasping surface that satisfies the foregoing objects.

Other objects and advantages of the present invention will be made clear in the following summary and detailed description of the preferred embodiments.

SUMMARY OF THE INVENTION

A door and drawer front for use in clean-rooms has an outer member having a front surface, a top surface, a bottom surface, a right side surface, and a left side surface. A recessed area is disposed in the front surface extending back into the outer member. The recessed area has a top grasping surface and a bottom grasping surface. A structural filling material may be disposed within the outer member. The intersections and corners of the outer member, the recess and the grasping surfaces form rounded junctions to facilitate easy cleaning and disinfecting of the door and drawer front.

In another embodiment the outer member has at least two adjacent panels, the panels each having a front surface, a top surface, a bottom surface, a right side surface, and a left side surface. The top surface and bottom surface between adjacent panels is abbreviated and connected together by a recessed connecting and torsional strengthening surface. The right side surface and left side surface between adjacent panels is continuous, but abbreviated to form a junction with the recessed connecting and torsional strenghthening surface;

The invention also includes a door and drawer pull embodying the recessed area and grasping surfaces described above. The preferred material for the invention is vacuum-formed plastic.

DETAILED DESCRIPTION OF THE PREFERRED EMBODIMENTS

Figure 1:
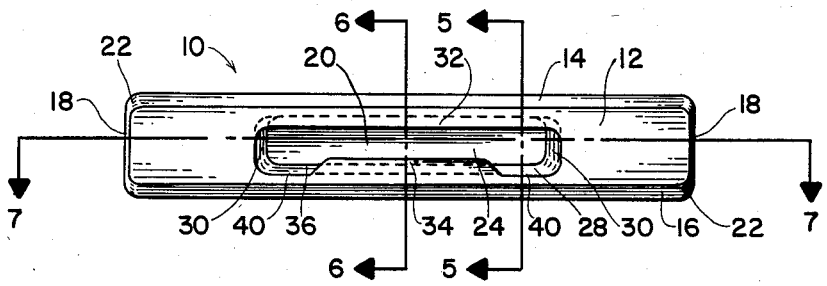
FIG. 1 is a front elevational view of a drawer front and a grasping surface embodying the principles of the present invention.

A drawer front 10 has a front planar surface 12, a topped angled suface 14, a bottom angled surface 16, a pair of somewhat angled side surfaces 18 and a recessed grasping area 20. Corner junctions 22 between the above-described surfaces 12–18 are rounded to facilitate easy cleaning and disinfecting of the drawer front 10.

Recessed grasping area 20 extends backwardly into front planar surface 12, having a back planar surface 24, a top, upwardly angled planar surface 26, a bottom, downwardly angled surface 28, a pair of side, outwardly angled surfaces 30 (see FIG. 7), an upper, downwardly extending lip 32, and a bottom, upwardly extending lip 34. The junctions 36 between the above-described surfaces 24–30, upper lip 32 and bottom lip 34 are all rounded to facilitate easy cleaning and disinfecting of the drawer front 10.

In order to further facilitate the cleaning and disinfecting of recessed area 20, the bottom lip 34 does not extend entirely across the recessed area, leaving open areas 40 on either side of bottom lip 34. In other words, two portions 40 of bottom, downwardly angled surface 28 extend uninterrupted between back planar surface 24 and front planar surface 12, a junction 42 between bottom surface 28 and front surface 12 being rounded to facilitate cleaning and disinfecting. Similarly, a sloped portion 44 having rounded corners 46 is provided between bottom lip 34 and open area 40.

Figure 4:
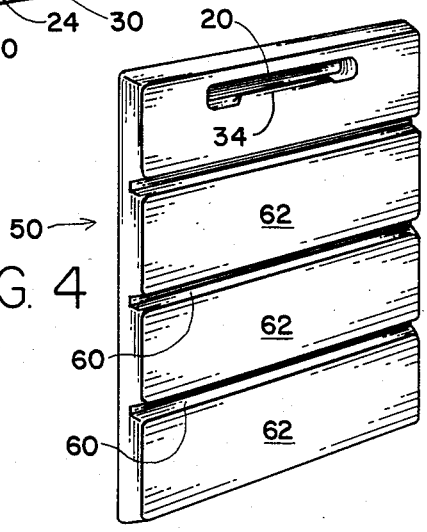
FIG. 4 is a side perspective view of a door and grasping surface embodying the principles of the present invention.
Figure 5:
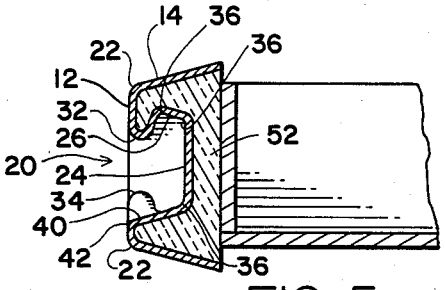
FIG. 5 is a cross-sectional view of the drawer front and grasping surface of FIG. 1, taken along line 5—5 in FIG. 1.
Figure 6:
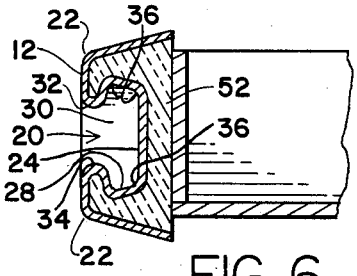
FIG. 6 is a cross-sectional view of the drawer front and grasping surface of FIG. 1, taken along line 6—6 in FIG. 1.

As illustrated in FIG. 4, the recessed grasping area 20 of the present invention is equally useful for a hinged door 50 as for a drawer front. In another embodiment, shown in FIG. 8, the bottom lip 34 is offset toward the side of the door opposite the hinged side, in order to provide better leverage for opening the door and to provide a visual indication of the direction in which the door opens.

Figure 2:
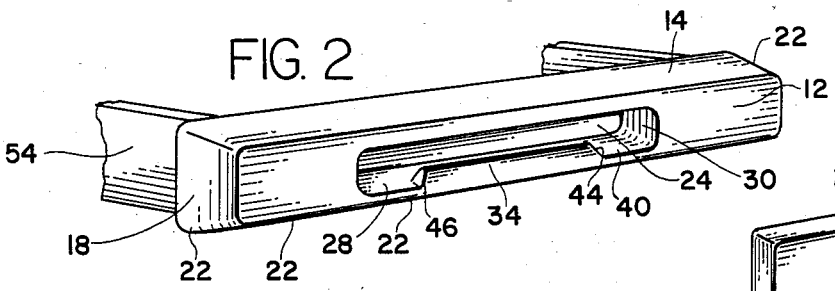
FIG. 2 is a front perspective view of a drawer and grasping surface embodying the principles of the present invention.
Figure 3:
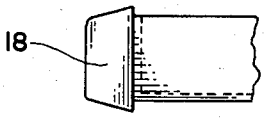
FIG. 3 is a right side elevational view of the drawer of FIG. 1.
Figure 7:
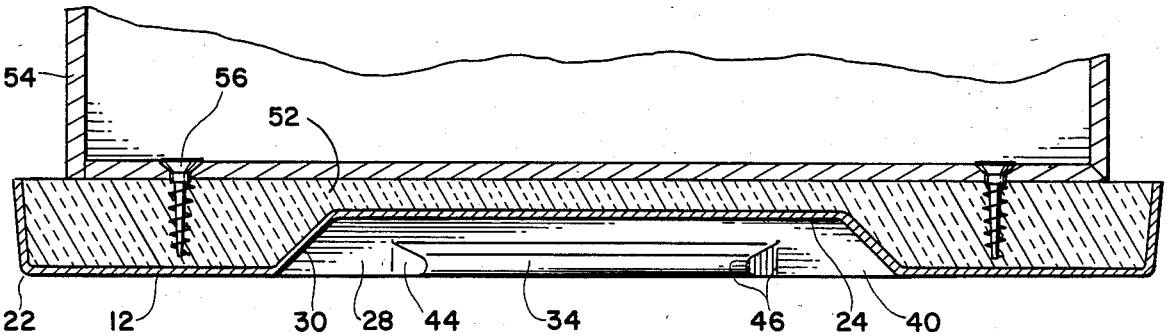
FIG. 7 is a cross sectional view of the drawer front and grasping surface of FIG. 1 taken along line 7—7 in FIG. 1.

The door and drawer front 10 of the present invention may be formed form a solid piece of material such as wood or plastic, and is preferably fabricated from a single piece of vacuum formed plastic, using a hinged mold part to form the upper lip 32 and the bottom lip 34. Once so-formed and set, a back compartment 52, defined by the back side of the door and drawer front 10 is filled with structural foam in order to provide structural and torsional rigidity to it. As illustrated in FIGS. 2, 3, and 7 the filled drawer front 10 may be attached to the front of a standard wooden or other material drawer 54 using screws 56, nails, staples, adhesive or other securing means (not shown). The securing means are held in the structural foam. In order to further enhance the sterility of the drawer 54, a tray (not shown) of sterilizable material for example polysulfone (Union Carbide), polyether sulfone (ICI Americas) and Ultem (G.E.) plastic, may be inserted into the drawer 54. In this manner, the plastic tray can be removed for cleaning and sterilization without the necessity of sterilizing an entire bulky drawer assembly.

As illustrated in FIG. 4, the door front 50 is provided with one or a plurality of horizontal indentations 60, which may also be provided for drawer fronts. The indentations, while serving the structural purpose of providing rigidity to door and drawer fronts of increasing length, serve an aesthetic purpose by maintaining the appearance of a constant line across the surface of a cabinet in which the drawer or door front is used, the panels 62 defined by the indentations 60 corresponding to the size of a typical drawer unit.

Figure 8:
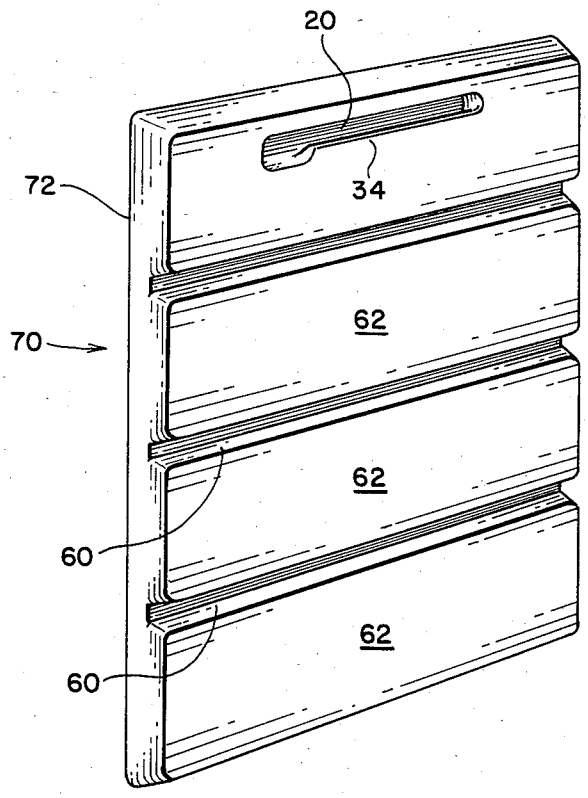
FIG. 8 is a side perspective view of a door and grasping surface embodying the principles of the present invention, wherein the bottom lip is offset.

FIG. 8 shows an alternative door front 70, of which side 72 is provided with hinges (not shown). The bottom lip 34 is offset toward the opposite side of the door, so that only one cleaning access portion is provided on the side closer to the hinged side of the door.

To those skilled in the art to which this invention relates, many changes in construction and widely differing embodiments and applications of the invention will suggest themselves without departing from the spirit and scope of the invention. For example, different materials can be used to form the drawer and door front; the degree of rounding at various corners may be modified; the lower lip may be extended across the entire width of the recessed area (provided that sufficient rounding is used to facilitate cleaning of the recessed area) or the lower or upper lip could be eliminated entirely for a fold down, slidingly recessable door front. The disclosure in the descriptions herein are purely illustrative and are not intended to be in any sense limiting.

What is claimed is:

1. A readily cleanable pull for a front surface of a drawer or door, comprising:

a recessed area extending into the front surface, the recessed area having top, bottom, left, right, and rear recess surfaces;

a downwardly extending protrusion between the top recess surface and the front surface, extending between the left and right recess surfaces, the downwardly extending protrusion having a front portion coplanar with the front surface, a back portion sloping toward the rear recess surface, and a rounded apex between the front and back portions; and an upwardly extending protrusion between the bottom recess surface and the front surface, disposed between the left and right recess surfaces but not in contact with at least one of the left and right recess surfaces thereby forming at least one cleaning access portion comprising a section of the junction between the front surface and the bottom recess surface having no upwardly extending protrusion, the upwardly extending protrusion having a front portion coplanar with the front surface, a back portion sloping toward the rear recess surface, and a rounded apex between the front and rear portions;

the junctions and corners between adjacent surfaces being rounded to facilitate cleaning and–disinfection.

2. The pull of claim 1, wherein:

the pull has cleaning access portions disposed on either side of the upwardly extending protrusion, the upwardly extending protrusion being disposed centrally between the left and right recess surfaces.

3. The pull of claim 1 particularly adapted for use with a door hinged at one side thereof, wherein:

the pull has a single cleaning access portion disposed on that side of the upwardly extending protrusion which is closer to the hinged side of the door, the upwardly extending protrusion extending to that side recess surface which is further removed from the hinged side of the door thereby indicating the direction in which the door opens and providing improved leverage for opening the door.

4. A readily cleanable front for a drawer or door, comprising:

an outer member having front, top, bottom, left, and right outer surfaces;

a recessed area extending into the front outer surface, the recessed area having top, bottom, left, right, and rear recess surfaces;

a downwardly extending protrusion between the top recess surface and the front outer surface, extending between the left and right recess surfaces, and downwardly extending protrusion having a front portion coplanar with the front outer surface, a back portion sloping toward the rear recess surface, and a rounded apex between the front and back portions;

an upwardly extending protrusion between the bottom recess surface and the front outer surface, disposed between the left and right recess surfaces but not in contact with at least one of the left and right recess surfaces thereby forming at least one cleaning access portion comprising a section of the junction between the front outer surface and the bottom recess surface having no upwardly extending protrusion, the upwardly extending protrusion having a front portion coplanar with the front outer surface, a back portion sloping toward the rear recess surface, and a rounded apex between the front ad rear portions;

the junctions and corners between adjacent surfaces being rounded to facilitate cleaning and disinfection.

5. The front of claim 4, wherein:

the front has cleaning access portions disposed on either side of the upwardly extending protrusion, the upwardly extending protrusion being disposed centrally between the left and right recess surfaces.

6. The front of claim 4 particularly adapted for use with a door hinged at one side thereof, wherein:

the front has a single cleaning access portion disposed on that side of the upwardly extending protrusion which is closer to the hinged side of the door, the upwardly extending protrusion extending to that side recess surface which is further removed from the hinged side of the door thereby indicating the direction in which the door opens and providing improved leverage for opening the door.

7. The front of claim 4, wherein:

the outer member comprises an outer shell having a structural filling material disposed in a back compartment defined by the front, top, bottom, left, and right outer surfaces, the recessed area extending into the back compartment.

8. The front of claim 5, wherein:

the outer shell is made from a single piece of plastic.

9. A readily cleanable front for a drawer or door, comprising:

an outer member having at least two adjacent panels disposed one above another, each of the panels having front, top, bottom, left, and right outer surfaces;

the top and bottom outer surfaces between adjacent panels being abbreviated and connected together by a recessed connecting and torsional strengthening surface; and the left and right outer surfaces of adjacent panels each being continuous but abbreviated to form a junction with the recessed connecting and torsional strengthening surface;

a recessed area extending into the front outer surface of one of the panels, the recessed area having top, bottom, left, right, and rear recess surfaces;

a downwardly extending protrusion between the top recess surface and the front outer surface, extending between the left and right recess surfaces, the downwardly extending protrusion having a front portion coplanar with the front outer surface, a back portion sloping toward the rear recess surface, and a rounded apex between the front and back portions; and an upwardly extending protrusion between the bottom recess surface and the front outer surface, disposed between the left and right recess surfaces but not in contact with at least one of the left and right recess surfaces thereby forming at least one cleaning access portion comprising a section of the junction between the front outer surface and the bottom recess surface having no upwardly extending protrusion, the upwardly extending protrusion having a front portion coplanar with the front outer surface, a back portion sloping toward the rear recess surface, and a rounded apex between the front and rear portions;

the junctions and corners between adjacent surfaces being rounded to facilitate cleaning and disinfection.

10. The front of claim 9, wherein:

the front has cleaning access portions disposed on either side of the upwardly extending protrusion, the upwardly extending protrusion being disposed centrally between the left and right recess surfaces.

11. The front of claim 9 particularly adapted for use with a door hinged at one side thereof, wherein:

the front has a single cleaning access portion disposed on that side of the upwardly extending protrusion which is closer to the hinged side of the door, the upwardly extending protrusion extending to that side recess surface which is further removed from the hinged side of the door thereby indicating the direction in which the door opens and providing improved leverage for opening the door.

12. The front of claim 9, wherein:

the outer member comprises an outer shell having a structural filling material disposed in a back compartment defined by the front, top, bottom, left, and right outer surfaces, the recessed area extending into the back compartment.

13. The front of claim 12, wherein:

the outer shell is made from a single piece of plastic.

* * * * *